United States Patent [19]

Perkitny

[11] Patent Number: 4,822,044

[45] Date of Patent: Apr. 18, 1989

[54] MOVING SURFACE MAGNETIC GAME

[76] Inventor: Jerzy Perkitny, 28115 Osborn Rd., Bay Village, Ohio 44140

[21] Appl. No.: 113,106

[22] Filed: Oct. 26, 1987

[51] Int. Cl.[4] ..... A63B 37/00; A63B 39/00; A63B 67/14

[52] U.S. Cl. ..... 273/109; 273/1 M; 273/58 F; 273/118 A; 273/128 A

[58] Field of Search ..... 273/58 F, 1 M, 1 GD, 273/118 A, 58 BA, 128 A, 109; 434/301; 446/137, 138

[56] References Cited

U.S. PATENT DOCUMENTS

| | | | |
|---|---|---|---|
| 2,665,912 | 1/1957 | Juran | 273/58 F |
| 3,102,362 | 9/1963 | Neal | 273/118 A |
| 3,655,197 | 4/1972 | Milbaum | 273/58 F |
| 3,995,855 | 12/1976 | Schultz | 273/58 F |
| 4,194,737 | 3/1980 | Farmer | 273/58 BA |
| 4,756,530 | 7/1988 | Karman | 273/113 |

FOREIGN PATENT DOCUMENTS

| | | | |
|---|---|---|---|
| 2155813 | 5/1973 | Fed. Rep. of Germany | 273/1 M |

*Primary Examiner*—Richard C. Pinkham
*Assistant Examiner*—Gary Jackson
*Attorney, Agent, or Firm*—Watts, Hoffmann Fisher & Heinke

[57] ABSTRACT

A game of manual dexterity having a hand manipulatable housing with a wall that presents a curved playing surface, an operating member having a magnetic portion and a weighted portion, and an object member separate from the housing, made of a ferromagnetic material and having a curved playing surface. The operating member is mounted within the housing so that the weighted portion maintains the magnetic portion in a position near the uppermost inner surface of the housing wall when the housing is turned. The object member is attracted to the magnetic portion of the operating member so that when the playing surfaces of the object member and housing are engaged, the object member is maintained in tracking engagement with the housing when it is turned.

13 Claims, 14 Drawing Sheets

MOVING SURFACE MAGNETIC GAME

TECHNICAL FIELD

This invention relates to a game of manual dexterity, and, more specifically, to a game in which an object ball or the like is balanced in magnetic tracking engagement with a curved playing surface of a hand-held housing and is moved over the playing surface by turning the housing.

DISCLOSURE OF THE INVENTION

The present invention provides a novel game of manual dexterity. The game preferably includes a primary housing and a secondary object member, each having a wall with a curved external surface of play. In each embodiment, the game is designed so that a player balances the object member on an uppermost portion of the curved playing surface of the housing. To play the game a player turns the housing to correspondingly move the object member while maintaining it in magnetic tracking engagement with the housing.

In the preferred embodiment of the invention an operating member is used within the primary housing to facilitate continued engagement of the housing and object member as the housing is turned. The operating member includes a magnetic portion and a weighted portion, and is mounted within the housing such that the weighted portion maintains the magnetic portion in a position uppermost near an inner surface of the housing wall as the housing is turned.

The object member includes a portion of ferromagnetic material. Upon engagement of the object member with the uppermost portion of the housing, the magnetic portion of the operating member attracts the object member and assists in maintaining it in balanced relationship when the housing is turned.

A variety of games are available which challenge players to test their manual skills. One advantage of the present invention is that it is playable by people of a broad range of ages, and also enables players of different ages and skill levels to play with one another. Players are also able to use this game either alone or with others, and to practice and improve certain abilities by playing the game, such as hand-eye coordination, and mental and manual dexterity. The game of the present invention is also simple to manufacture and safe for use by players of all ages.

Further objects and advantages of the present invention will be referred to in or become apparent from the following descriptions of the preferred embodiments of the invention.

BEST MODE FOR CARRYING OUT THE INVENTION

Figure 1:
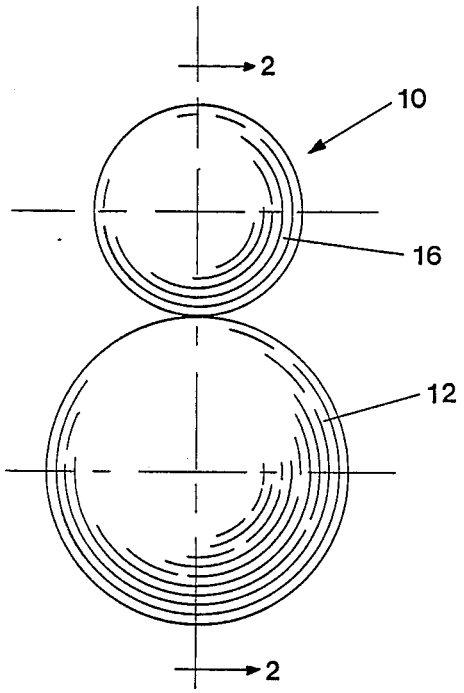
FIG. 1 is a front view of a housing and object member according to one embodiment of the invention.
Figure 2:
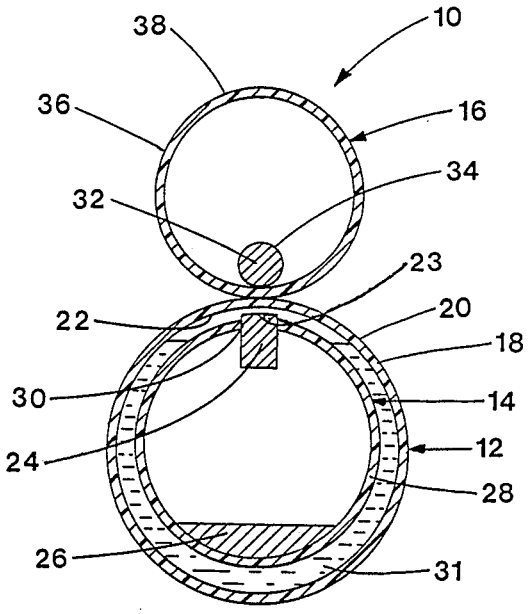
FIG. 2 is a cross-sectional view taken along the line 2—2 of FIG. 1.

Referring to FIGS. 1 and 2 of the drawings, the game of the present invention is generally designated at reference character 10. As illustrated in FIG. 2, the game comprises a hand manipulatable housing 12, an operating member 14 mounted within the housing, and an object member 16 separate from and engageable with the housing 12.

The housing 12 comprises a spherical shell or wall 18 with a curved external playing surface 20 and an inner surface 22.

The operating member 14 is mounted within the housing 12 and preferably includes a magnetic portion 24 and a weighted portion 26. The weighted portion is mounted within the operating member to operate as a conventional counterweight mechanism so that the magnetic portion 24 is always positioned uppermost with respect to the weighted portion upon movement of the housing. The magnetic portion 24 is thus positioned nearest an uppermost portion 23 of the inner surface 22 of the housing wall 18 when the housing is turned and the game is played. As shown in the embodiment of FIG. 2, the operating member comprises a spherical shell 28 with the magnetic portion projecting through an aperture 30 in the shell for positioning adjacent the uppermost portion 23. As shown, the weighted portion is within the shell opposite the magnetic portion. The shell 28 of the operating member floats on liquid 31 intermediate the inner surface 22 to absorb excess noise which may occur when the housing is turned, and to ensure smooth and continuous movement of the operating member within the housing.

The object member 16 is separate from the housing 12 and, as shown in the embodiment of FIG. 2, comprises a portion of ferromagnetic material 32 having a curved surface 34. The portion 32 is within a spherical shell 36 which includes an external playing surface 38 which is engageable with the curved playing surface 20 of the housing. The ferromagnetic material portion 32 of the object member is attracted to the magnetic portion 24 through the shell 36 and the wall 18 when the member 16 is in a balanced position as shown in FIG. 2. The attraction of the ferromagnetic material portion 32 to the magnetic portion 24 maintains the object member in tracking engagement with the housing when it is turned, and assists the player in maintaining the object member in the balanced position during movement of the housing.

Figure 3:
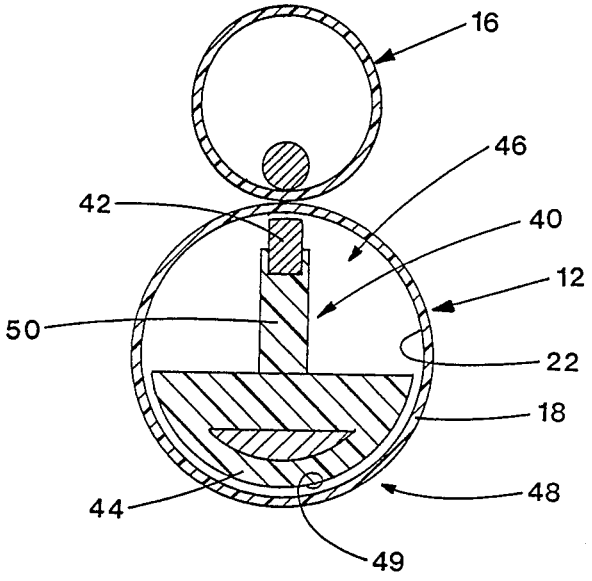
FIG. 3 is a cross-sectional view of a second embodiment of the invention.
Figure 4:
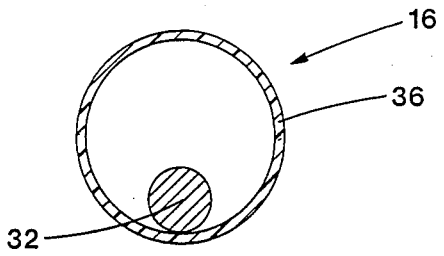
FIGS. 4 to 7 are cross-sectional views of four embodiments of object members of the present invention.
Figure 5:
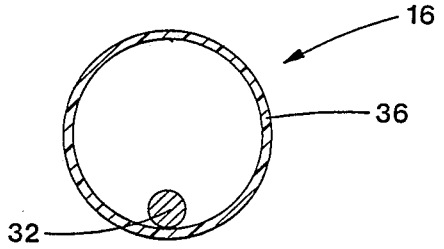

Referring to FIG. 3, a second embodiment of the operating member, generally designated at reference numeral 40, is mounted within the housing 12 of the present invention. The operating member 40 preferably includes a magnetic portion 42 and a weighted portion 44. The magnetic portion is secured at one end of the member 46 and the weighted portion at an opposite end 48 The weighted portion is of a spherical configuration and includes a curved contact surface 49 for engagement with the inner surface 22 of the housing. The weighted portion is interconnected with the magnetic portion via an interconnecting member 50. To reduce friction resulting from engagement of the contact surface 49 of the weighted end 48 with the inner surface 22 during movement of the housing either or both of the contacting surfaces may be coated with an anti-friction material (not illustrated).

Figure 7:
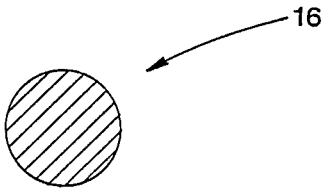
Figure 8:
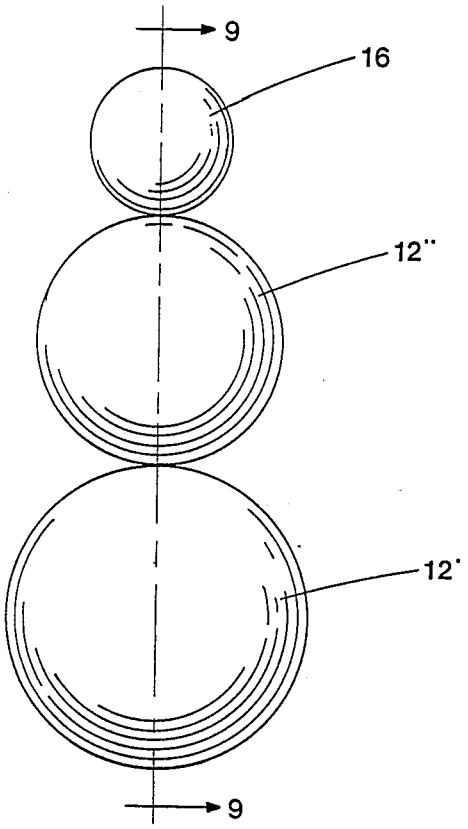
FIG. 8 is a front view of a third embodiment of the present invention.
Figure 9:
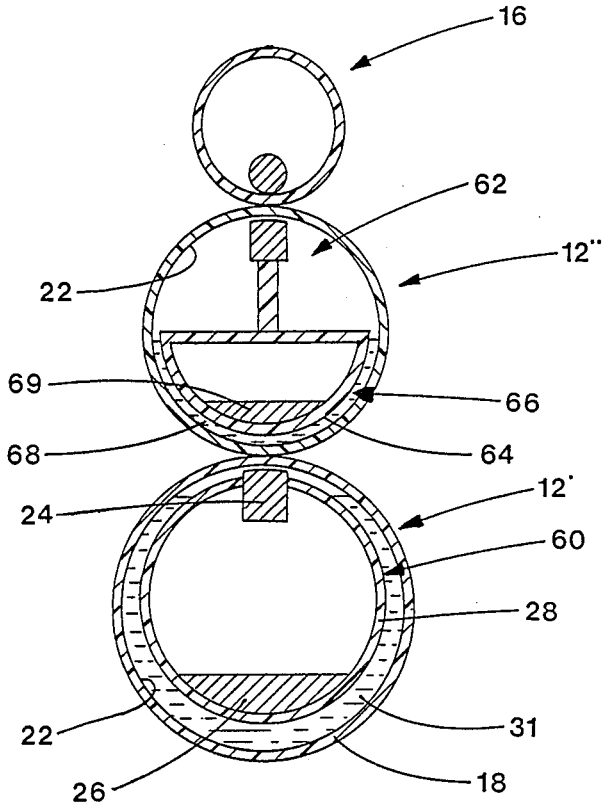
FIG. 9 is a cross-sectional view taken along the line 9—9 of FIG. 8.

FIGS. 8 and 9 illustrate another embodiment of the game wherein two housing and operating member combinations are engaged with the object member 16 which is balanced in an uppermost position with respect to the two housings. The operating member within the first housing 12', and designated at reference numeral 60, is identical to that of FIG. 2. The operating member 62 within the second housing 12" is similar to that of FIG. 3, however, in this embodiment the curved contact surface 64 of the weighted end 66 floats on liquid 68 intermediate the surface 64 and an inner surface 22 of the housing wall. To maintain the intermediate housing 12" in tracking engagement with the housing 12', the operating member 62 includes a weighted portion 69 of a ferromagnetic material. In this embodiment, the weighted portion in housing 12" is thus attracted to the magnetic portion 24 of housing 12'. The intermediate housing 12" is preferably of a light construction so that it is more easily maintained in the illustrated position. Although the housings 12', 12" are illustrated in FIG. 9 having different embodiments, the housings may be of the same or other embodiments such as those illustrated in FIGS. 1–16.

Figure 10:
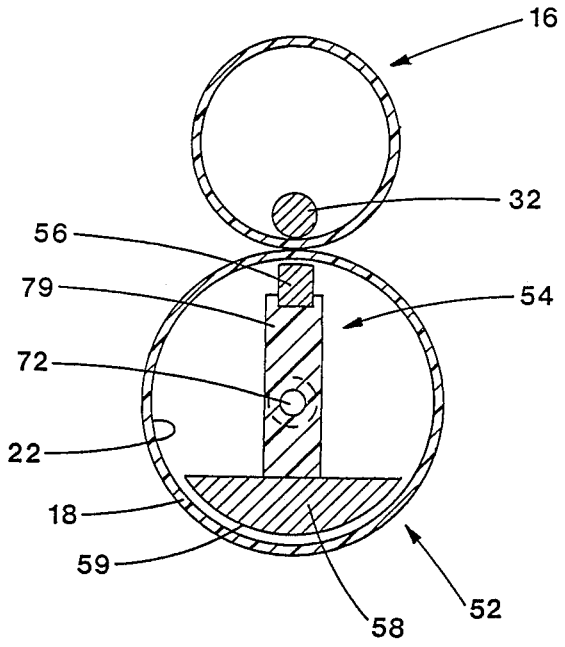
FIG. 10 is a cross-sectional end view of a fourth embodiment of the present invention.
Figure 11:
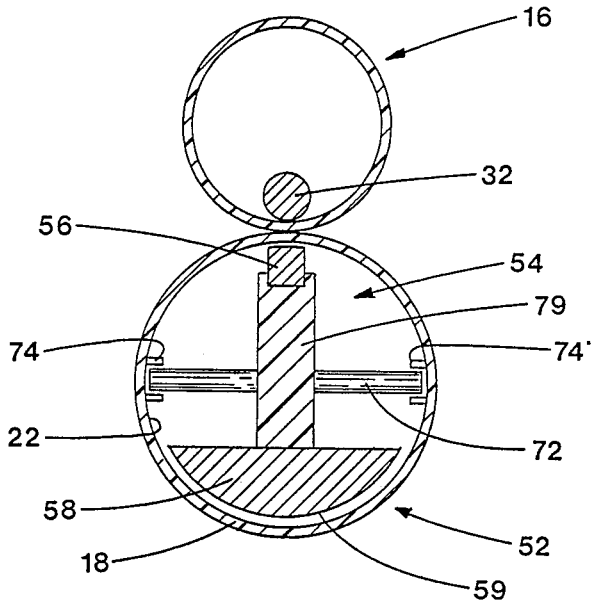
FIG. 11 is a cross-sectional side view of the embodiment of FIG. 10.

Referring to FIGS. 10 and 11, another spherical embodiment of the housing and an operating member of the present invention are generally designated at reference numerals 52 and 54, respectively. The operating member 54 includes a magnetic portion 56 and a weighted portion 58 having a curved surface 59 associated with the inner surface 22 of the housing 52. The magnetic and weighted portions are positioned on opposing ends of the operating member intermediate an interconnecting member 79. The operating member is journaled within the housing 52 for rotation about an axle 72. The axle is preferably secured within opposite projecting annular portions 74, 74' on the inner surface of the housing wall 18. Thus to maintain the object member 16 in tracking engagement as illustrated, the housing 52 may only be rotated about the axle 72.

Figure 12:
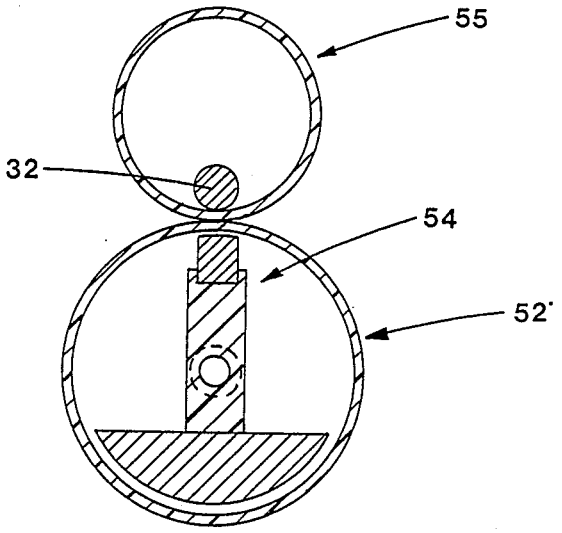
FIG. 12 is a cross-sectional end view of a fifth embodiment of the present invention.
Figure 13:
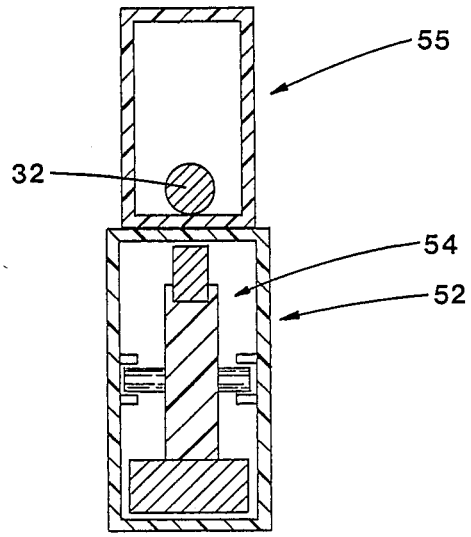
FIG. 13 is a cross-sectional side view of the embodiment of FIG. 12.

As the embodiment of the invention illustrated in FIGS. 12 and 13 is similar to that of FIGS. 10 and 11, differing only in that the housing 52' and object member 55 have a cylindrical rather than a spherical configuration, this embodiment will not be discussed in further detail.

Figure 14:
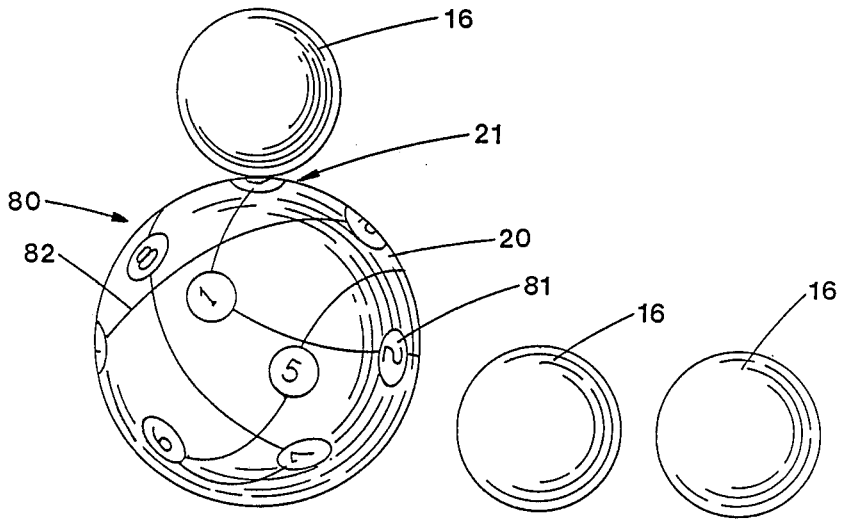
FIG. 14 is a perspective view of the game of the present invention having one form of markings on the housing.

To play the game, the object member 16 is positioned on an uppermost portion 21 of the curved external playing surface 20 of the housing. While holding the housing 12 and maintaining the object member 16 in a balanced position as shown in FIG. 14, the player then turns the housing to move the object member across the external playing surface 20 of the housing 18. Upon movement of the housing, the weighted portion 26 of the operating member maintains the magnetic portion 24 in a position uppermost with respect to the inner surface 22 of the housing. The magnetic attraction between the object member and the housing assists the player in maintaining the object member in tracking engagement with the curved external playing surface 20. As shown in FIG. 14, markings 80 are presented on the playing surface 20. Points are scored by hand manipulation of the housing such that the object member moves across the curved playing surface following the pattern of the markings as in FIG. 14. The illustrated markings include discrete portions 81 which are assigned point values, and a pattern 82 interconnecting the markings. The player is awarded the point value of each marking 81 when it is aligned with the object member. The player able to accumulate the highest number of points is the winner.

Figure 15:
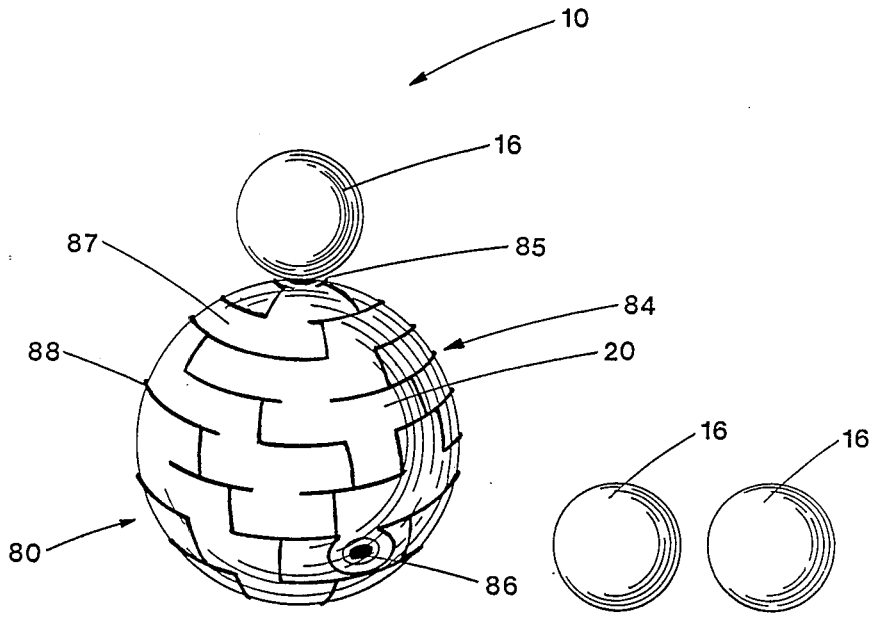
FIG. 15 is a perspective view of the game of the present invention having markings in the form of curbs on the housing.

The housing of FIG. 15 illustrates another form of marking 80 which may be used on the playing surface 20. The marking comprises a labyrinth pattern 84 with a starting area 85 and a finish area 86. The intricate passageways 87 are defined between the start and finish by curbs 88 which are raised from the external playing surface of the housing. The game of this embodiment is played by movement of the object member 16 along the passageways 87 between the curbs 88 from the starting area to the finish area. Movement of the object member across the curbs, however, results in the object member being dismounted from the balanced position.

Figure 16:
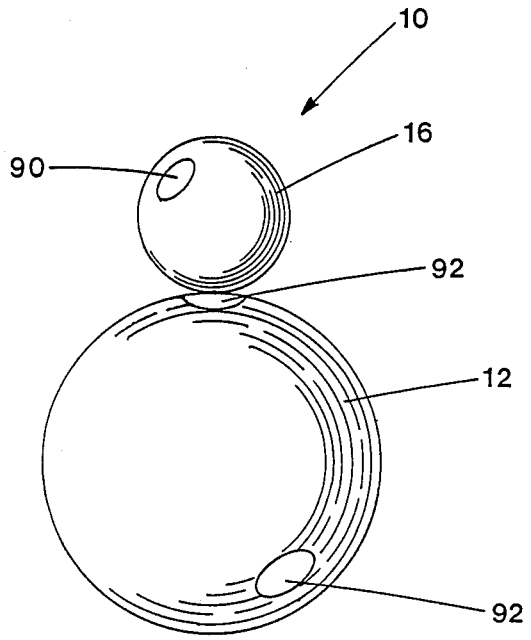
FIG. 16 is a perspective view of the game of the present invention having complementary markings on the housing and object member.

An additional form of markings for use with the game of the present invention are shown in FIG. 16. The markings in this embodiment are complementary such that the goal of the players is to align the markings of the object member 90 with the markings on the playing surface of the housing 92. Mental tactics as well as manual ability must be used to anticipate correct alignment of the markings 90, 92, since the surfaces of the object member and housing are different sizes.

To accommodate the needs of players having different levels of dexterity, object members of the type shown in FIGS. 4 to 7 may be used interchangeably when the game is played. The object member 16 of FIG. 4 includes a portion of ferromagnetic material 32 of a size which makes it attractive to the magnetic portion 24, and thus more easily maintained in tracking engagement with the housing. Alternatively, the object member of FIG. 5 includes a portion of ferromagnetic material 32 which is substantially smaller in size, is less attractive to the magnetic portion 24, and thus more care must be taken to maintain the object member in tracking engagement with the housing. Using object members of different types, i.e., which are more magnetically attracted to the housing, enables persons of lesser skill levels to compete on an equal basis with persons of greater skill levels. Object members with different sized portions of ferromagnetic material may also be color coded and chosen for tactical purposes by players of equal skill, such that increased point values may be earned by player using the object members colored to indicate they are "harder" to maintain in tracking engagement with the housing.

Figure 6:
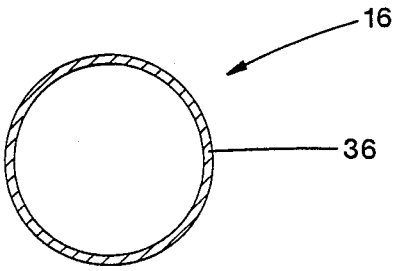

FIG. 6 shows an alternate embodiment of an object member having a shell 36 of ferromagnetic material, while FIG. 7 illustrates an embodiment of the operating member which comprises a solid sphere of ferromagnetic material. These forms and sizes of object members may also be used to accommodate players with different skill levels.

From these descriptions of the preferred embodiment of the invention disclosed herein it will be evident that there is provided a novel game which may be constructed in a variety of manners. While the preferred embodiments of the invention have been described in detail, it will be apparent that the invention can be incorporated in games having various constructions and different combinations, and it is the intention to cover devices incorporating the present invention as defined by the appended claims.

I claim:

1. A game comprising:

(a) a hand manipulatable housing having a wall which presents a curved external playing surface;

(b) an operating member having a magnetic portion and a weighted portion;

(c) means mounting said operating member for movement within said housing so that said weighted portion maintains said magnetic portion uppermost near an inner surface of said wall as said housing is turned;

(d) an object member separate from said housing, said object member at least in part being of a ferromagnetic material and having a curved surface;

(e) said object member being engageable with said curved playing surface of said housing, whereby said magnetic portion will attract said object member to maintain it in tracking engagement with said housing when it is turned.

2. The game of claim 1 wherein the external playing surface of the housing includes markings.

3. The game of claim 2 wherein it is played by turning said housing to move said magnetic portion and object member in tracking engagement past said markings.

4. The game of claim 2 wherein the markings comprise a labyrinth having a starting area and a finish area and defined intermediate said areas by curbs raised from the external playing surface of the housing.

5. The game of claim 2 wherein said operating member includes an internal spherical shell movable within said housing and having said magnetic and weighted portions mounted thereon.

6. The game of claim 1 wherein the housing comprises a closed cylindrical shell having an axis of rotation, whereby said operating member is journaled within said shell for rotation about said axis when said housing is turned.

7. The game of claim 6 wherein said object member is housed within a closed cylindrical shell having an external playing surface for engagement with said housing.

8. A game comprising:

(a) a hand manipulatable spherical housing having a wall which presents a continuous external playing surface, said external playing surface including markings;

(b) an operating member having a magnetic portion and a weighted portion;

(c) means mounting said operating member for movement within said housing so that said weighted portion maintains said magnetic portion uppermost near an inner surface of said wall as said housing is turned;

(d) an object member separate from said housing having a curved surface, being made of a ferromagnetic material and being housed within a spherical shell having an external playing surface;

(e) said external playing surface of said object member shell being engageable with said playing surface of said housing, whereby said magnetic portion will attract said object member and maintain it in tracking engagement with said housing as it is turned.

9. The game of claim 8 wherein it is played by turning said housing to move said magnetic portion and object member in tracking engagement past markings.

10. The game of claim 9 wherein scoring comprises awarding points to a player for maintaining said object member in a balanced position while moving said magnetic portion and object member past markings having assigned point values.

11. The game of claim 8 or 5 wherein a shock absorbing means is contained within said housing intermediate the wall and the operating member for absorbing shock and enabling smooth movement of said operating member within said housing.

12. The game of claim 11 wherein said shock absorbing means comprises a liquid.

13. A game comprising:

(a) a hand manipulatable housing having a curved external playing surface;

(b) an object member separate from said housing and having a curved surface;

(c) one of either said housing or object member having a magnetic portion and the other of said housing or object member having a portion of ferromagnetic material;

(d) means mounting one of said portions for movement within said housing so that said portion is maintained uppermost near an inner surface of said curved external playing surface as said housing is turned;

(e) said object member being engageable with said curved playing surface of said housing, whereby said magnetic portion will attract said portion of ferromagnetic material and maintain said object member in tracking engagement with said housing when it is turned.

* * * * *